US006644993B2

(12) United States Patent
Victor

(10) Patent No.: US 6,644,993 B2
(45) **Date of Patent: *Nov. 11, 2003**

(54) INTERCHANGEABLE CONNECTOR SYSTEM WITH BAYONET MOUNT

(75) Inventor: Jay E. Victor, Pacifica, CA (US)

(73) Assignee: Monster Cable Products, Inc., Brisbane, CA (US)

( * ) Notice: Subject to any disclaimer, the term of this patent is extended or adjusted under 35 U.S.C. 154(b) by 90 days.

This patent is subject to a terminal disclaimer.

(21) Appl. No.: 10/082,940

(22) Filed: Feb. 25, 2002

(65) Prior Publication Data

US 2003/0102934 A1 Jun. 5, 2003

Related U.S. Application Data

(63) Continuation of application No. 09/754,855, filed on Jan. 4, 2001, now Pat. No. 6,406,313.

(51) Int. Cl.[7] ..... H01R 29/00
(52) U.S. Cl. ..... 439/175; 439/578
(58) Field of Search ..... 439/63, 175, 174, 439/578, 628, 172, 176, 585, 488, 957, 891

(56) References Cited

U.S. PATENT DOCUMENTS 2,238,934 A * 4/1941 Travers ..... 439/461
2,731,614 A * 1/1956 Geib et al. ..... 439/668
D244,611 S * 6/1977 Gietzen ..... D13/133
4,367,001 A * 1/1983 Munakata ..... 439/175
4,781,619 A * 11/1988 Ikeda ..... 439/488
4,857,014 A * 8/1989 Alf et al. ..... 439/578
4,944,686 A * 7/1990 Gertz ..... 439/175
4,964,816 A * 10/1990 Miller ..... 439/417
D318,260 S * 7/1991 Lee ..... D13/133
5,180,317 A * 1/1993 Franks, Jr. ..... 439/669
5,261,839 A * 11/1993 Franks, Jr. ..... 439/669
5,321,207 A * 6/1994 Huang ..... 174/75 C
5,419,707 A * 5/1995 Kelley ..... 439/21
5,498,838 A * 3/1996 Furman ..... 174/74 R
5,527,190 A * 6/1996 Weingartner ..... 439/462
5,791,919 A * 8/1998 Brisson et al. ..... 439/166
6,004,172 A * 12/1999 Kerek ..... 439/891
6,129,568 A * 10/2000 Mercurio et al. ..... 439/166
6,146,166 A * 11/2000 Muzslay ..... 439/176
6,168,458 B1 * 1/2001 Kraft ..... 439/488
6,176,716 B1 * 1/2001 Mercurio et al. ..... 439/166

* cited by examiner

*Primary Examiner*—Tulsidas Patel
(74) *Attorney, Agent, or Firm*—LaRiviere, Grubman & Payne, LLP

(57) ABSTRACT

An Interchangeable Connector System providing for the interchangeable removable installation of a variety of Terminators, such as plugs and sockets, and a variety of Shells or covers, to a Common Connector Body. The installation and removal of the Shells and Terminators is performed after the Common Connector Body is connected to the cable, and does not require the disconnection of the cable from the Common Connector Body.

9 Claims, 9 Drawing Sheets

INTERCHANGEABLE CONNECTOR SYSTEM WITH BAYONET MOUNT

CROSS REFERENCE TO RELATED APPLICATION

This continuation application claims priority from U.S. Ser. No. 09/754,855, filed Jan. 4, 2001, now issued as U.S. Pat. No. 6,406,313 B1 on Jun. 18, 2002.

COPYRIGHT STATEMENT

A portion of the disclosure of this patent document contains material which is subject to copyright protection. The copyright owner has no objection to the facsimile reproduction by anyone of the patent document or the patent disclosure, as it appears in the U.S. Patent and Trademark Office patent files or records, but otherwise reserves all copyright rights whatsoever.

BACKGROUND OF THE INVENTION

This invention relates to connectors for cables conducting electromagnetic waves generally and more specifically to connectors, plugs, and sockets for audiovisual and other electronic equipment having interchangeable components.

When using cables or wires to connect such things as sound amplification or video equipment, it is sometimes desirable to change the terminating plug or socket on one or both ends of a cable, or to change the type, color, or other feature of the shell which covers and protects the ends of the cable. Since it is usually desirable to solder or tightly crimp the ends of the conductors of a cable to the terminating plug or socket, and since the cover or shell is usually placed on the cable before such soldering or crimping, it is difficult to change either the terminator or the shell of a cable which has already been made up.

SUMMARY OF THE INVENTION

The Interchangeable Connector System overcomes the problem of a lack of interchangeability among terminating plugs and sockets and shells or covers by providing a system of interchangeable Terminators and Shells which can be mounted or changed after the soldering or crimping of the conductors of a cable to a Common Connector Body. The Shells and Terminators can be mounted or changed without having to remove the cable from the Common Connector Body, thus providing a very flexible and reusable system.

DETAILED DESCRIPTION OF THE INVENTION

Figure 1:
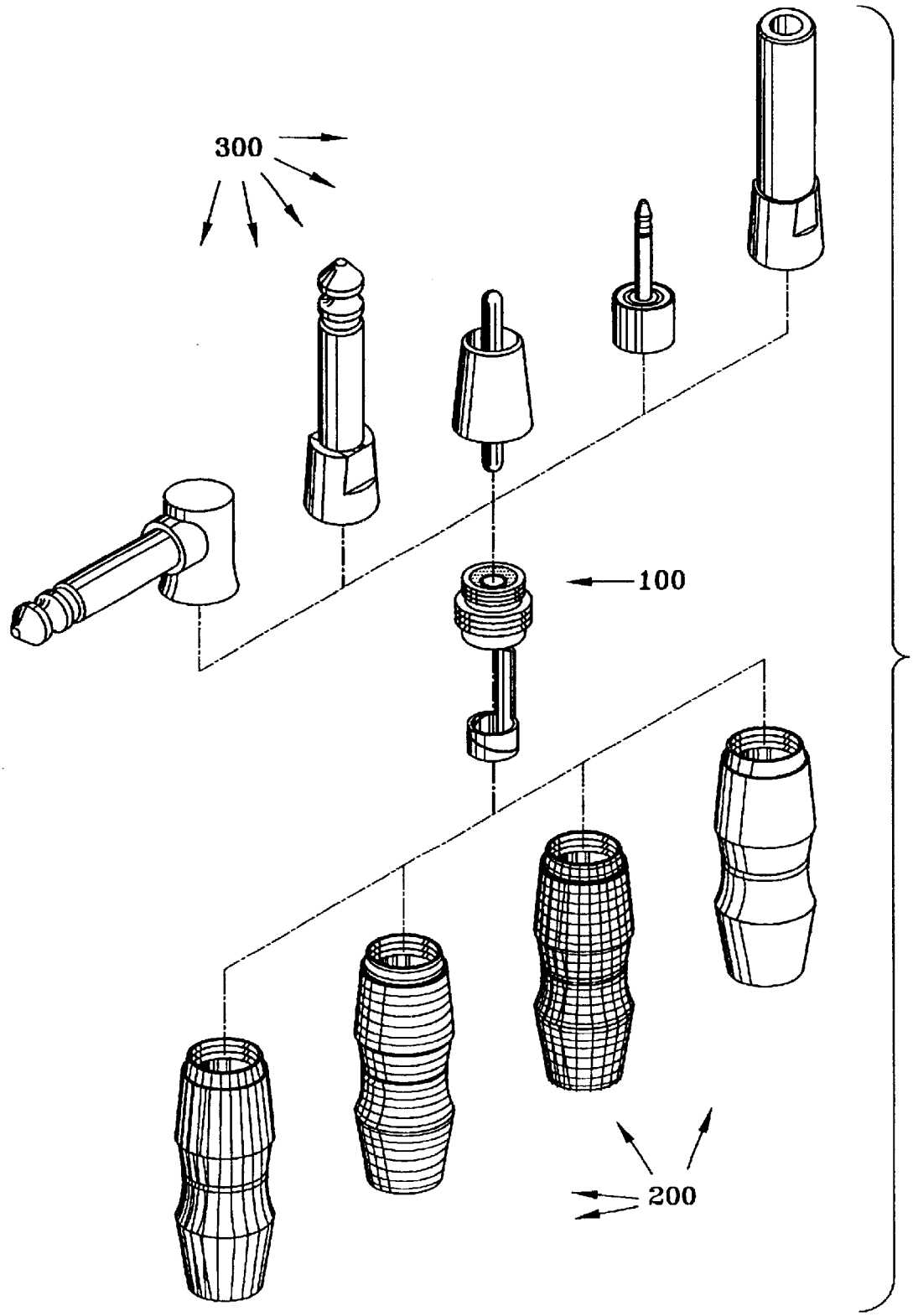
FIG. 1 shows an exploded overview in perspective of an Interchangeable Connector System according to the present invention.

This invention, an Interchangeable Connector System, shown in overview in FIG. 1, provides for the interchangeable assembly of a variety of Terminators 300 and Shells 200 onto a Common Connector Body 100. In an alternative embodiment, shown in overview in FIG. 10, the Interchangeable Connector System provides for the interchangeable assembly of a variety of Terminators 300 onto a Common Connector Body 100 to which a Shell has been molded, creating a Common Connector Body with Molded Shell 500.

Figure 2:
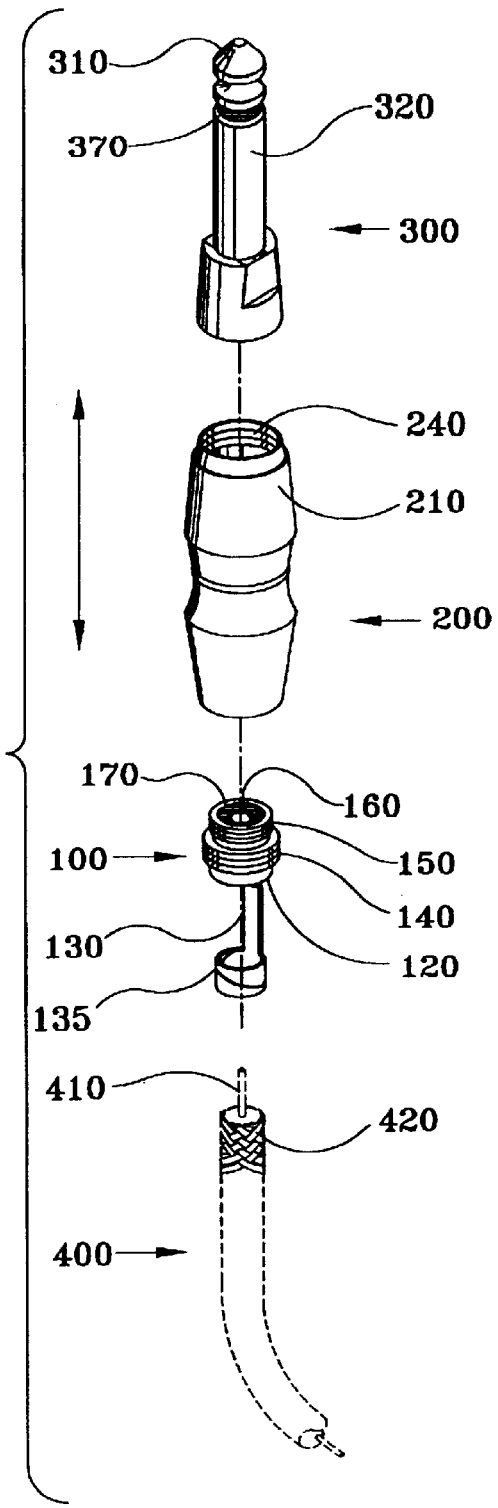
FIG. 2 shows an exploded perspective view of one configuration of the system of FIG. 1.

In the system of this invention, the Common Connector Body 100 is fixedly coupled to a cable 400 shown in FIG. 2 which conducts electromagnetic waves. The cable could be an audio or video cable which conducts electrical signals, or a fiber-optic cable which conducts modulated light, or it could be another type of cable conducting an electromagnetic wave. The fixed coupling of the cable to the Common Connector Body could be by a number of means, including soldering, crimping, or welding for an electrically conductive cable and gluing for an optically conductive cable. Clamping is another means of fixedly coupling a cable to the Common Connector Body. The coupling of the cable to the Common Connector Body is considered to be fixed because in practice it is desirable not to undo the coupling even if it is possible to do so, for instance by desoldering. A feature of the present invention is that an uncoupling of the cable 400 from the Common Connector Body 100 is not necessary in order to change Terminators 300 or, in an embodiment, Shells 200.

In contrast to the fixed coupling of the Common Connector Body 100 to the cable 400, the Terminators 300 and, in an embodiment, the Shells 200 are removably mounted and interchangeably mounted on the Common Connector Body 100. As will be further shown, the present invention provides Terminators 300 and, in an embodiment, Shells 200 which can be mounted on the Common Connector Body 100 after the Common Connector Body 100 has been fixedly coupled to the cable 400, and which can be removed and replaced with another Terminator 300 or Shell 200 without having to uncouple the Common Connector Body 100 from the cable 400. A preferred embodiment of this invention provides a method of mounting the Terminators 300 and Shells 200 on the Common Connector Body 100 by a means such as a threaded area, a bayonet mount, or some similar, removable means. Mounting the Terminators and Shells in such an easily removable way provides a system having great flexibility for being changed and reconfigured without special tools.

An embodiment of the present invention, with an electrically conductive cable having one conductor and a shield, with the connection terminating in a ¼-inch phone plug, is illustrated and described. The practice of this invention for other types of terminators, for multiple-conductor cables, and for optically conductive terminators and cables, is described in this document.

Figure 3:
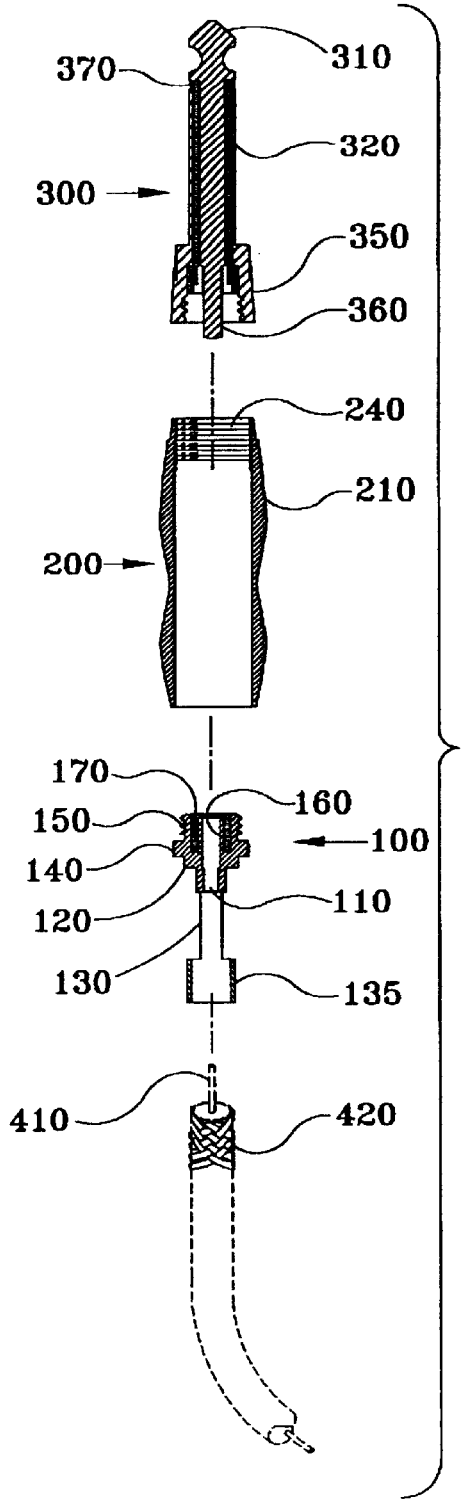
FIG. 3 shows a section view of the system of FIG. 2.
Figure 4:
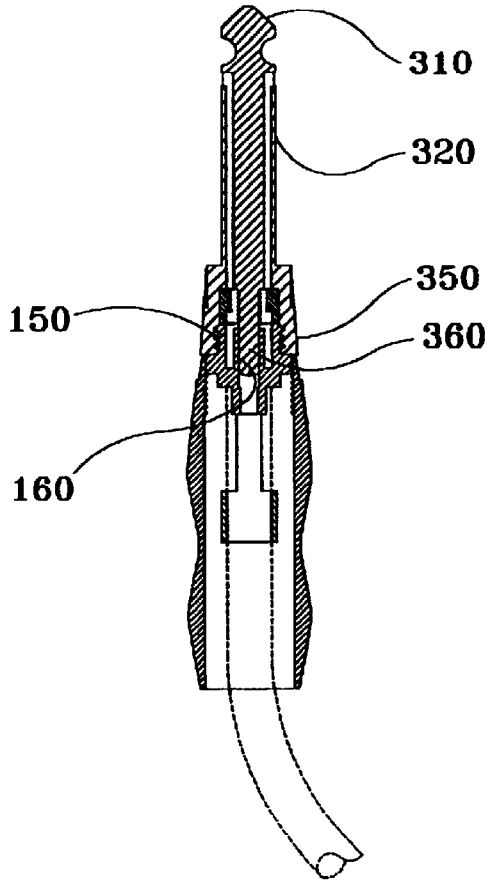
FIG. 4 shows a longitudinal cross-sectional view of an assembled Interchangeable Connector System according to the present invention.
Figure 5:
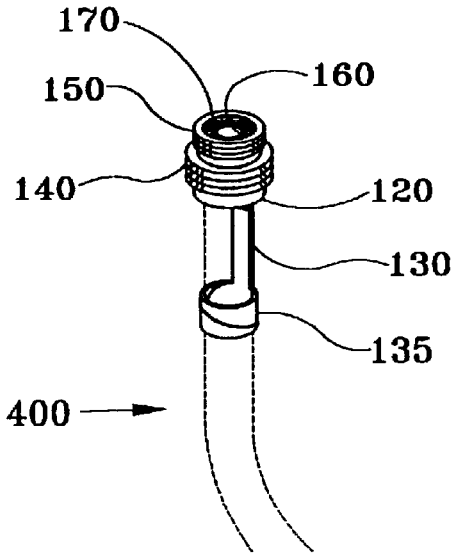
FIG. 5 shows a perspective view of a Common Connector Body coupled to a shielded cable.

Referring now to FIGS. 2, 3, & 5, the Common Connector Body 100 is designed to be coupled to a cable 400 by soldering, crimping, or other suitable attachment. The coupling to a conductor or conductors of a cable can be supplemented by a mechanical coupling to provide strain relief. In a single-conductor embodiment, as shown in FIG. 3, the conductor 410 of a cable 400 is electrically coupled to a cable contact point 110 of the Common Connector Body. The shield 420 of the cable is electrically coupled to the main body 1120 of the Common Connector Body, either directly or by attachment to a strain relief 130 or strain relief tabs 135 where the strain relief and strain relief tabs are electrically connected to the main body. The cable contact point 110 conducts an electrical signal to a contact receptacle 160. The electrical path from the cable contact point to the contact receptacle is electrically insulated from the main body 120. One way to achieve this insulation is with an insulator 170. The cable 400 may be further mechanically secured to the strain relief 130 and strain relief tabs 135. In an embodiment with more than one conductor, the cable contact point 110 and the contact receptacle 160 are divided into more than one electrically insulated paths.

Figure 6:
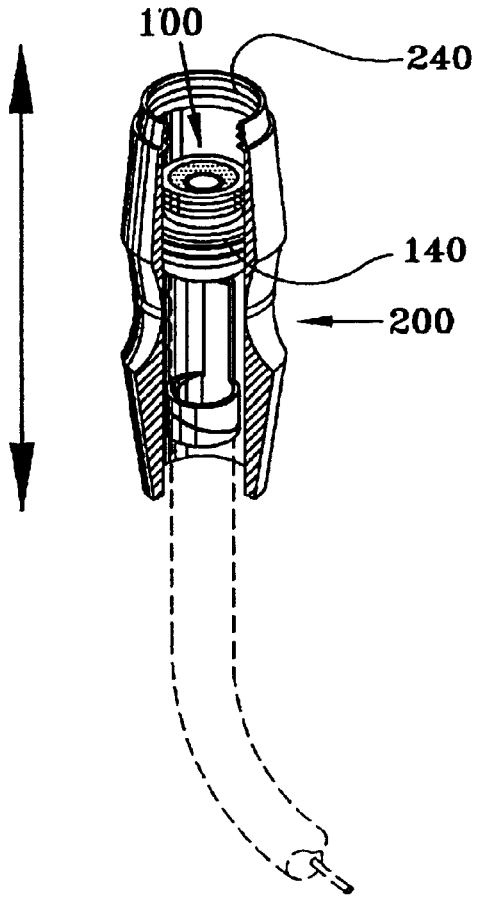
FIG. 6 shows a cutaway view of a Shell during assembly onto the Common Connector Body after the Common Connector Body has been coupled to a cable.
Figure 7:
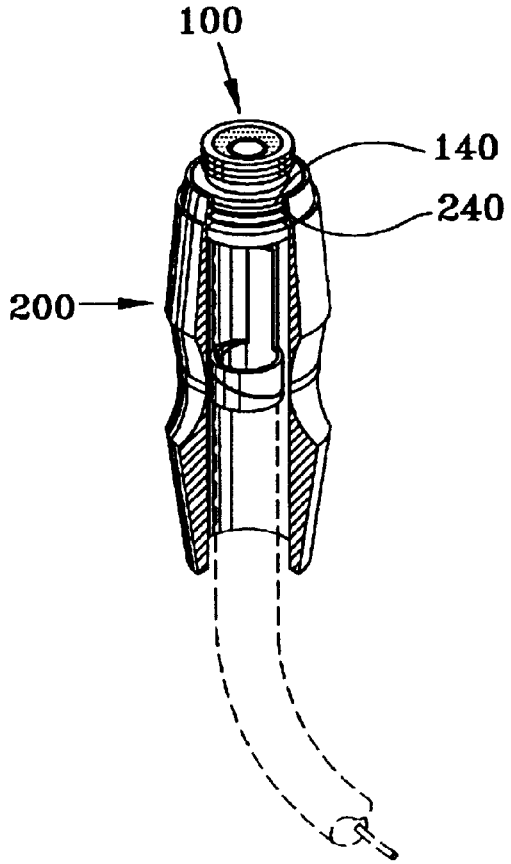
FIG. 7 shows a cutaway view of a Shell assembled onto the Common Connector Body of FIG. 6.
Figure 7A:
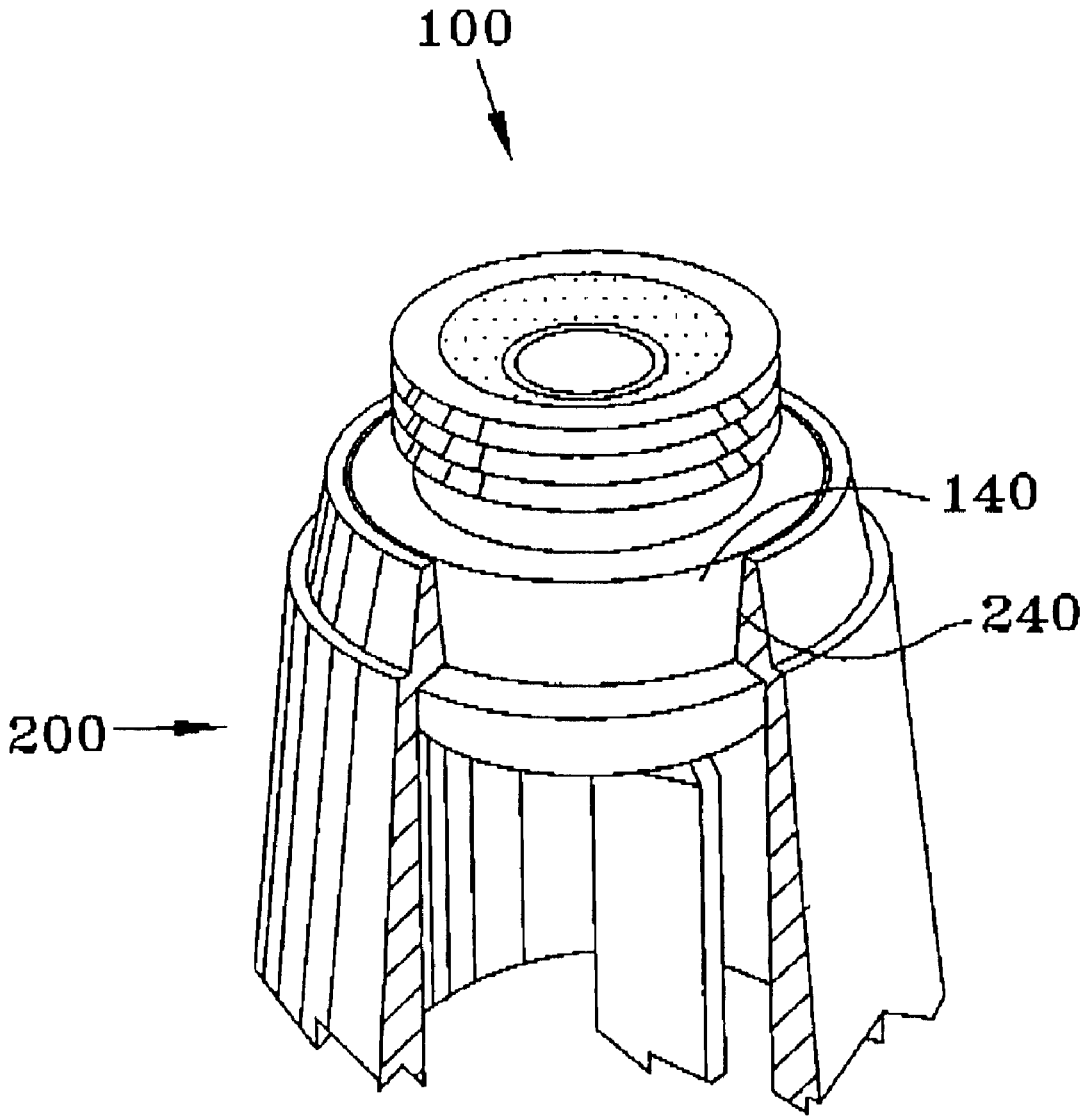
FIG. 7A is an expanded detail of FIG. 7.
Figure 10:
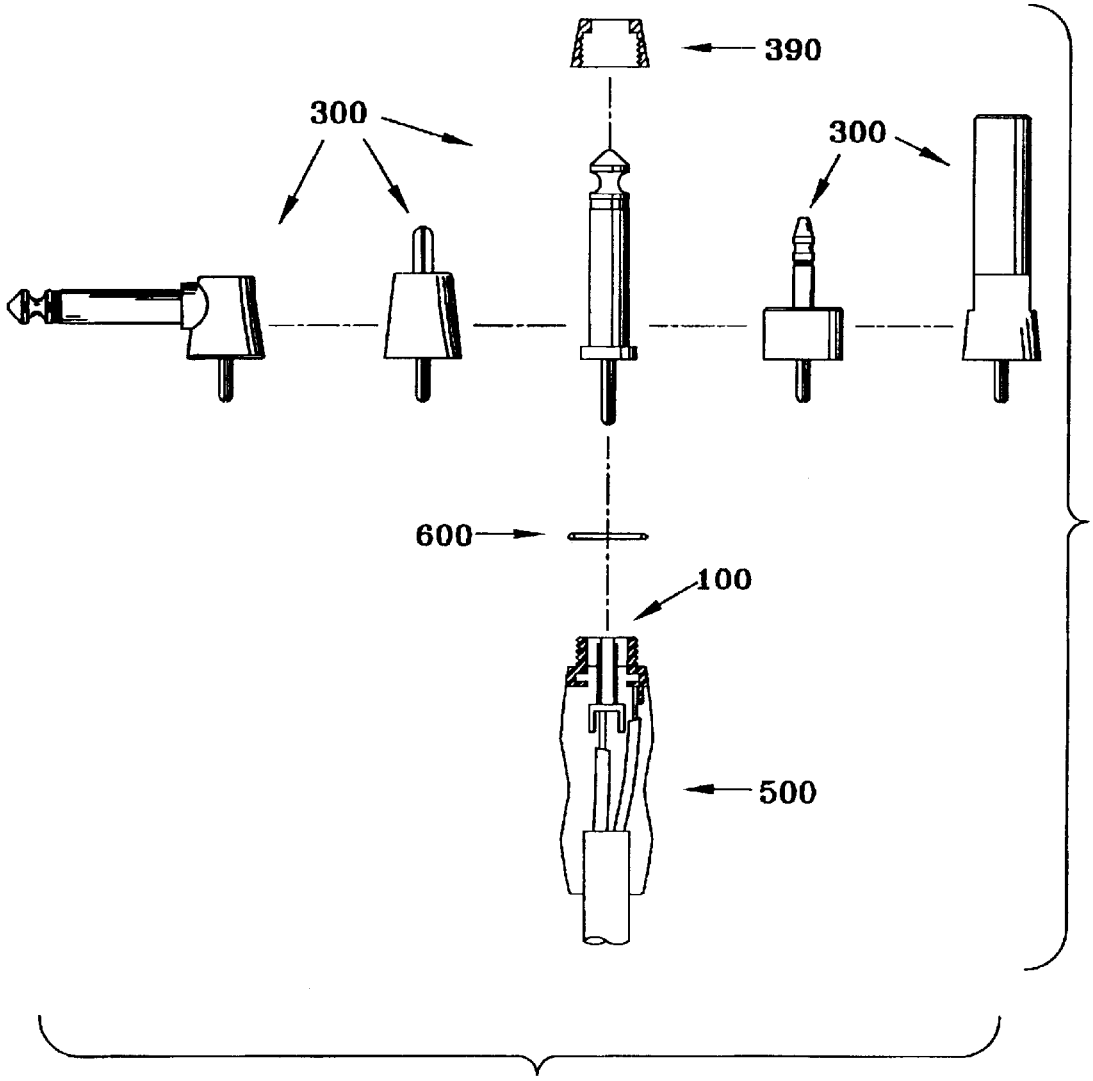
FIG. 10 shows an overview in elevation of an alternative embodiment of the Interchangeable Connector System according to the present invention.
Figure 11:
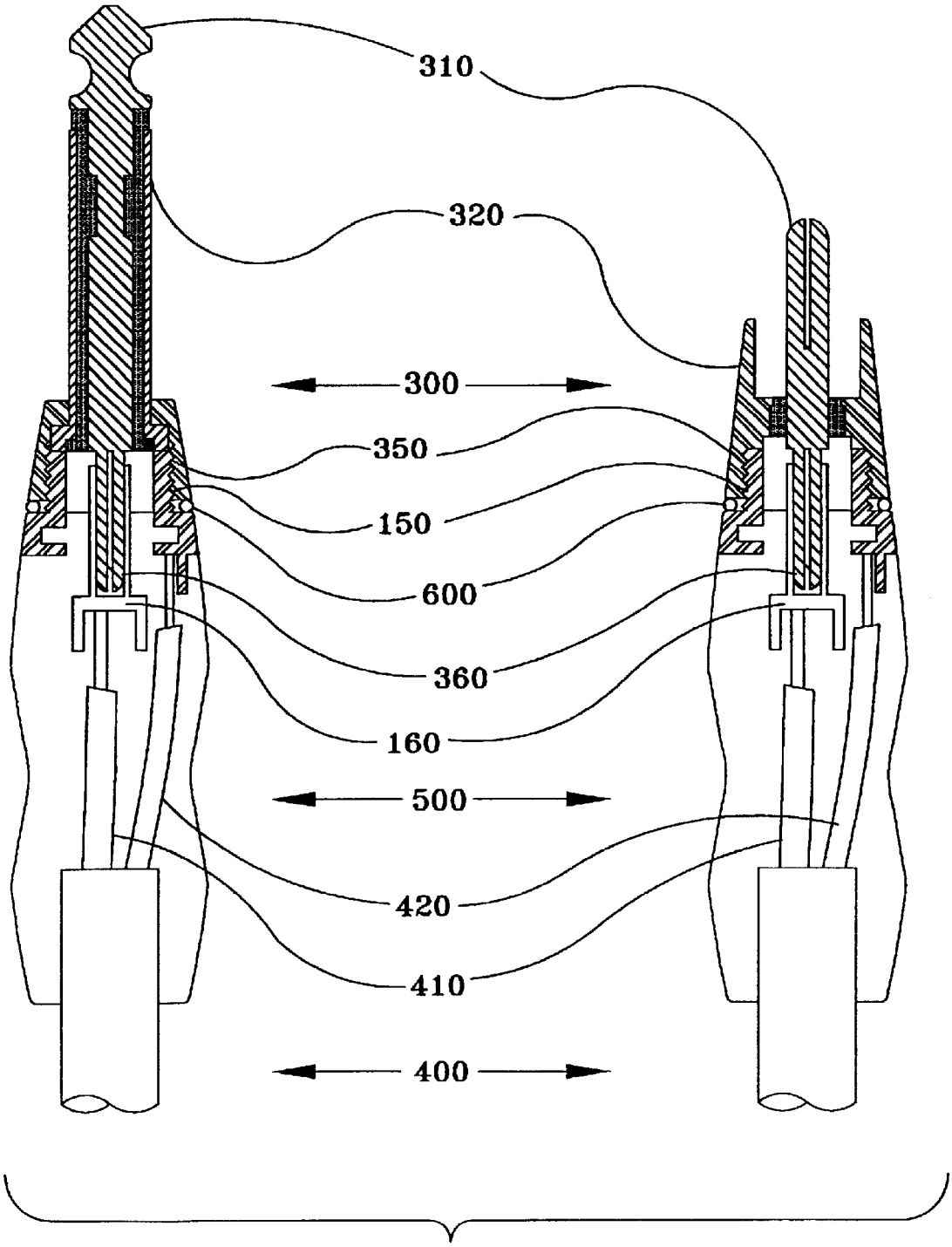
FIG. 11 shows a section view of two assembled Interchangeable Connector Systems of the alternative embodiment of FIG. 10.

In order to protect the coupling points of the cable 400 to the Common Connector Body 100 and to complete the overall integrity of the connection, a Shell 200 may be interchangeably mounted on the Common Connector Body as shown in FIGS. 6 & 7. Alternatively, a Shell may be molded to the Common Connector Body 100 creating a Common Connector Body with Molded Shell 500, as shown in FIGS. 10 & 11.

The interchangeable Shell 200 may be of a color or texture or shape or can incorporate a design feature that differentiates the assembled connector from others. The Shells 200 are easily interchangeable because they can be mounted over the Common Connector Body 100 while the cable 400 remains coupled. Therefore the Shell on a cable can be changed for one of a different appearance or feel in order to identify, for instance, a different use or point of connection for the cable.

The Shell 200 is placed over and coupled to the Common Connector Body 100. In a preferred embodiment, a larger threaded portion 140 of the Common Connector Body engages a threaded portion 240 of the Shell. Alternatively, the attachment of the Shell to the Common Connector Body could be achieved with a bayonet mount or another type of mount. FIG. 7 shows the Shell 200 mounted on the Common Connector Body 100. Detail 7A shows a bayonet mount having a smooth exterior surface 140 and a correspondingly sized receiver 240 having a smooth inner surface.

Figure 8:
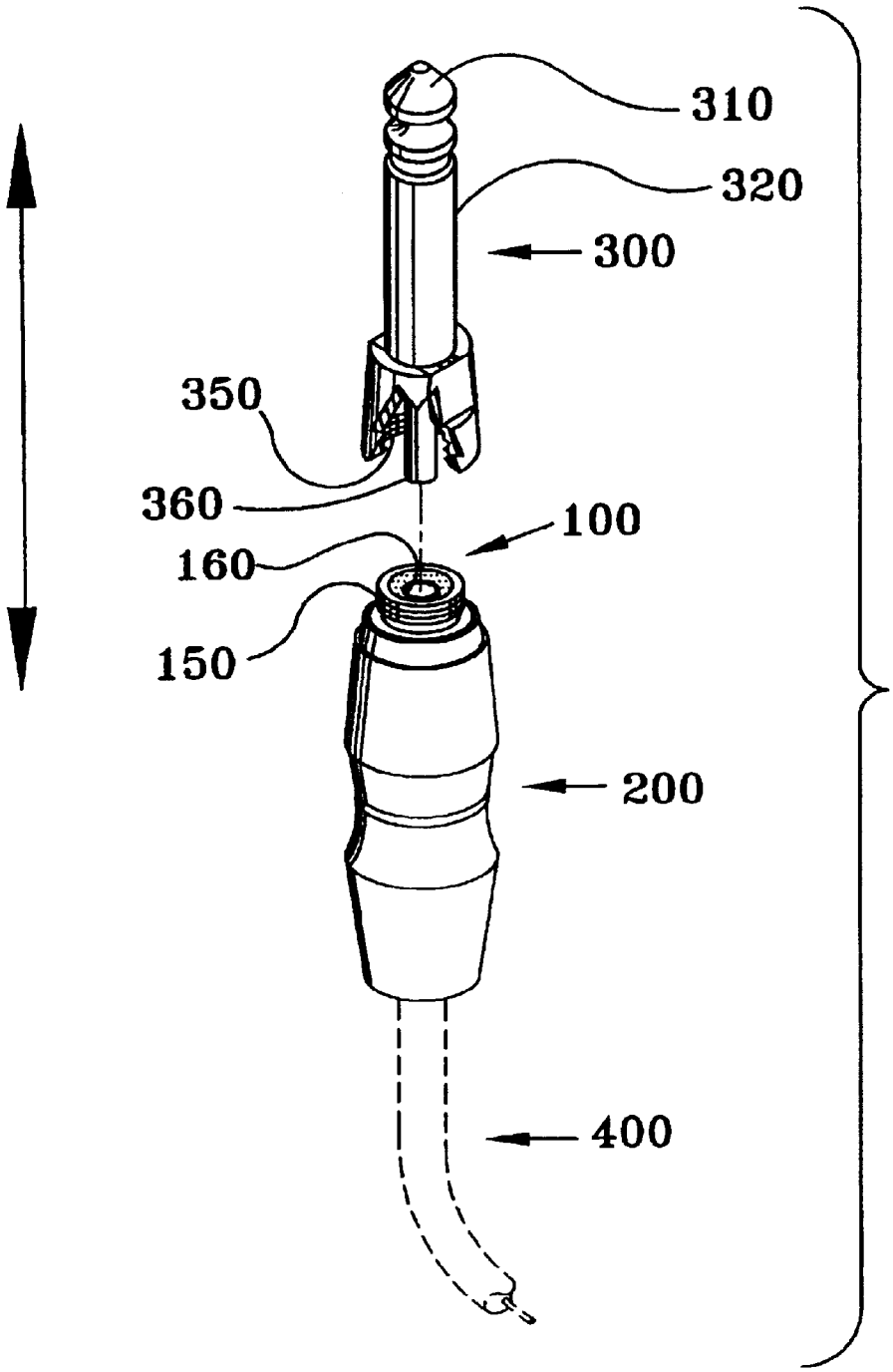
FIG. 8 shows an exploded perspective view of a Terminator during assembly with the Shell and the Common Connector Body of FIG. 7.

As shown in FIG. 8, a Terminator 300 is interchangeably coupled to the Common Connector Body 100. In one embodiment, the Common Connector Body 100 is fitted with an interchangeable Shell 200. In an alternative embodiment as shown in FIG. 10, a Shell has been molded to the Common Connector Body 500. The Terminator 300 will normally be a plug, but could be a socket or a spade lug. As shown in FIG. 10, the Terminator can be a single assembly, or can be an assembly which attaches to the Common Connector Body using a separate collet 390. As shown in FIGS. 10 & 11, a ring 600 or washer of rubber, plastic, or other material can optionally be mounted between the Terminator 300 and the Common Connector Body 100.

The specific configuration of a Terminator may vary depending on the nature of the Terminator. A single-conductor ¼ inch plug, for instance, will have a tip portion 310 and a ring portion 320 (FIGS. 2 & 3). The tip portion 310 conducts an electrical signal to the contact pin 360, which is adapted to fit into and make electrical contact with the contact receptacle 160 of the Common Connector Body. The ring portion 320 conducts an electrical signal to the threaded portion 350 of the Terminator, which is adapted to attach to, and make electrical contact with, the smaller threaded portion 150 of the Common Connector Body.

Portions corresponding to the tip and ring portions of the ¼ inch plug will exist in other types of plugs, in sockets, and in the other types of Terminators in this system. FIG. 11 shows the corresponding tip 310 and ring 320 portions of an RCA-type or co-axial plug. In a system with more than one conductor, there will be more than two portions of the Terminator. For example, in a stereo plug, there will be three electrically separate portions.

In a preferred embodiment, a smaller threaded portion 150 of the Common Connector Body engages a threaded portion 350 of the Terminator in order to mechanically attach the Terminator 300 to the Common Connector Body. This mechanical attachment also creates an electrical attachment between the main body 120 of the Common Connector Body 100 and a tip portion 310 of the Terminator. A ring portion 320 of the Terminator is electrically coupled through the contact pin 360 to the contact receptacle 160. Since the contact receptacle 160 is electrically connected to the cable contact point 110, which is electrically coupled to the conductor 410 of a cable, and the main body 120 is electrically coupled to the shield 420 or second conductor of the cable 400, in the assembled connector system, the tip portion 310 is electrically coupled to the conductor 410 and the ring portion 320 is electrically coupled to the shield 420 or second conductor of the cable 400.

In an embodiment having more than one conductor, the tip 310 and the corresponding contact pin 360 may be divided into more than one electrically insulated paths, adapted to make contact with a similarly divided contact receptacle 160 which in turn is electrically coupled to a divided contact point 110 or plural contact points.

The Terminators can be provided in a wide variety of connector types, including but not limited to straight and angled versions of, and both plug and socket versions of, ¼-inch phone connectors, mini-phone connectors, RCA or co-axial type connectors, photographic electronic flash connectors of the PC-type or other types, and banana connectors. The Terminators may also be provided as spade lugs.

Figure 9:
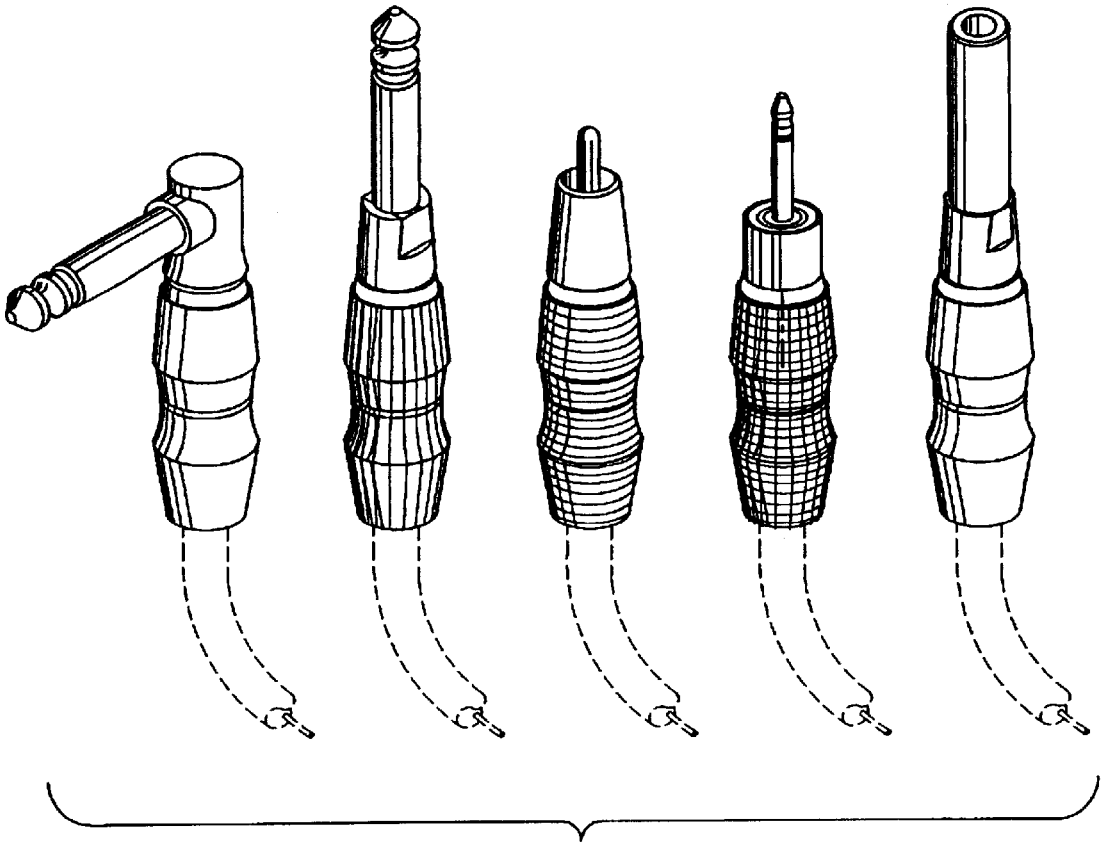
FIG. 9 shows a perspective view of a variety of assembled Interchangeable Connector Systems according to the present invention.

With the Interchangeable Connector System, the Terminators and, in a preferred embodiment, the Shells can be removed and reassembled after the initial assembly of the cables Shells, and Terminators. This interchangeability is possible without having to disconnect the cable from the Common Connector Body, and can therefore be done quickly, in the field, without the need for a soldering iron or other special tool. FIG. 9 shows some of the variety of Terminators and Shells which can be interchangeably assembled with this system.

In accordance with the principles of the present invention, a "Connector Body Means" is a mechanical element which provides 1) a coupling point or points upon which to couple the conductor or conductors of a cable, 2) a point or points upon which to removably mount a Terminator in such a way that the signal of the conductor or conductors of the cable is carried through to the Terminator Means, and, in an embodiment of the invention, 3) a surface upon which to removably mount a Shell Means. The mounting and removal of the Terminators and, in an embodiment, the Shells, may be done without having to uncouple the cable from the Connector Body Means. Examples of the preferred ways of coupling the conductors of a cable to the Connector Body Means are soldering and crimping for an electrically conductive cable and gluing for an optically conductive cable.

In accordance with the principles of the present invention, a "Terminator Means" is a mechanical element which may be removably mounted on the Connector Body Means in such a way that the signal of the conductor or conductors of the cable is carried through to the Terminator Means.

In accordance with the principles of the present invention, a "Shell Means" is a mechanical element which may be removably mounted on the Connector Body Means. The purpose of the Shell Means is partly structural, to protect the point of coupling of the cable to the Connector Body Means and to provide a gripping surface for the user of the system, and partly informative or decorative, since different properties of a Shell Means, such as color, texture, size, and shape may be used to differentiate terminated cables under this system.

In operation, a person using the Interchangeable Connector System might be setting up or making changes to an audiovisual system and need, for instance, to substitute a loudspeaker requiring a ¼-inch phone plug connector in place of a loudspeaker requiring an RCA-type plug. The person would unmount the RCA-type plug Terminator from the Common Connector Body of an already made-up cable and mount a ¼-inch phone plug Terminator in its place, thus changing the configuration of the cable without having to uncouple the cable from the Common Connector Body and without any special tools. The person might also exchange the Shell covering an end of a cable for a Shell of a different color, shape, or texture in order to indicate that the purpose of the cable had changed. This exchanging of Shells could be accomplished without uncoupling the cable from the Common Connector Body, and without any special tools.

Using this system, a provider of cables could offer various terminators and shells and separately offer lengths of cable with Common Connector Bodies securely coupled to both ends. The customers of such a provider of cables could then obtain the exact length and grade of cable desired, and separately obtain the exact Terminators and Shells desired. The customer could then assemble these components without special tools, and could change the configuration as needed.

While a preferred form of the invention has been described and shown in the drawings, since variations in the preferred form will be apparent to those skilled in the art, the invention should not be construed as limited to the specific form shown and described, but instead should be construed as set forth in the following claims.

I claim:

1. An interchangeable connector system comprising:

a common connector body having a first and a second end, fixedly coupled at the first end to a cable for conducting electromagnetic waves;

a plurality of interchangeable shells, each one designed to be removably mounted one at a time on the common connector body without uncoupling the cable for conducting electromagnetic waves from the common connector body, wherein the common connector body first end further includes external screw threads and each interchangeable shell further includes internal screw threads to engage the screw threads of the common connector body, so that each interchangeable shell can be unmounted by unscrewing the interchangeable shell from the common connector body; and a plurality of interchangeable terminators, each one designed to be removably mounted one at a time on the common connector body at the second end.

2. The interchangeable connector system of claim 1 wherein the interchangeable terminators are plugs and sockets of the type used in making connections among audiovisual equipment components.

3. The interchangeable connector system of claim 1 wherein the interchangeable terminators are selected from the group consisting of straight and angled versions of ¼-inch phone plugs and sockets, mini plugs and sockets, RCA or co-axial type plugs and sockets, banana blugs and sockets, and spade lugs.

4. The interchangeable connector system of claim 1 wherein the interchangeable shells are provided in a plurality of colors, finishes, shapes, and textures.

5. An interchangeable connector system comprising:

a common connector body having a first and a second end, fixedly coupled at the first end to a cable for conducting electromagnetic waves;

a plurality of interchangeable shells, each one designed to be removably mounted one at a time on the common connector body without uncoupling the cable for conducting electromagnetic waves from the common connector body, wherein the common connector body further includes an external bayonet mount and each interchangeable shell further includes an internal bayonet mount to engage the bayonet mount of the common connector body, so that each interchangeable shell can be unmounted by sliding it over and off of the common connector body; and a plurality of interchangeable terminators, each one designed to be removable mounted one at a time on the common connector body at the second end.

6. The interchangeable connector system of claim 5 wherein the interchangeable terminators are plugs and sockets of the type used in making connections among audiovisual equipment components.

7. The interchangeable connector system of claim 5 wherein the interchangeable terminators are selected from a group consisting of straight and angled versions of ¼-inch phone plugs and sockets, mini plugs and sockets, RCA or co-axial type plugs and sockets, banana plugs and sockets, and spade lugs.

8. The interchangeable connector system of claim 5 wherein the interchangeable shells are provided in a plurality of colors, finishes, shapes, and textures.

9. A method of assembling interchangeable connectors comprising:

providing a common connector body having a first end and a second end; fixedly coupling a cable for conducting electromagnetic waves to the common connector body first end;

removably mounting one of a plurality of interchangeable shells on the common connector body without uncoupling the cable for conducting electromagnetic waves from the common connector body, wherein the common connector body first end further includes external screw threads and each interchangeable shell further includes internal screw threads to engage the screw threads of the common connector body, so that each interchangeable shell can be unmounted by unscrewing the interchangeable shell from the common connector body; and removably mounting one of a plurality of interchangeable terminators on the common connector body at the second end.

* * * * *